US010046356B2

(12) United States Patent
Ikagawa et al.

(10) Patent No.: US 10,046,356 B2
(45) Date of Patent: Aug. 14, 2018

(54) COATING APPARATUS AND COATING METHOD

(71) Applicant: TAZMO CO., LTD., Okayama (JP)

(72) Inventors: Yoshinori Ikagawa, Okayama (JP); Naoki Tsuo, Okayama (JP)

(73) Assignee: TAZMO CO., LTD., Okayama (JP)

( * ) Notice: Subject to any disclaimer, the term of this patent is extended or adjusted under 35 U.S.C. 154(b) by 472 days.

(21) Appl. No.: 14/361,906

(22) PCT Filed: Oct. 17, 2012

(86) PCT No.: PCT/JP2012/076803

§ 371 (c)(1),
(2) Date: May 30, 2014

(87) PCT Pub. No.: WO2013/080688

PCT Pub. Date: Jun. 6, 2013

(65) Prior Publication Data

US 2015/0298162 A1 Oct. 22, 2015

(30) Foreign Application Priority Data

Dec. 1, 2011 (JP) ..... 2011-263220

(51) Int. Cl.
*B05C 11/10* (2006.01)
*B05D 1/02* (2006.01)
(Continued)

(52) U.S. Cl.
CPC ..... *B05D 1/02* (2013.01); *B05B 1/34* (2013.01); *B05C 11/10* (2013.01);
(Continued)

(58) Field of Classification Search
CPC .... B05C 11/10; B05C 11/1002; B05C 5/0258
See application file for complete search history.

(56) References Cited

U.S. PATENT DOCUMENTS 5,882,408 A * 3/1999 Fujita ..... B05C 11/1026 118/410
5,989,622 A * 11/1999 Iwashita ..... B05C 5/0254 427/256

(Continued)

FOREIGN PATENT DOCUMENTS

JP 06-034770 U 5/1994
JP 2000-005682 A 1/2000

(Continued)

OTHER PUBLICATIONS

International Search Report for corresponding International Application No. PCT/JP2012/076803 dated Nov. 27, 2012.

*Primary Examiner* — Dah-Wei D. Yuan
*Assistant Examiner* — Stephen A Kitt
(74) *Attorney, Agent, or Firm* — Renner, Otto, Boisselle & Sklar, LLP

(57) ABSTRACT

This coating device according to the present invention comprises a slit nozzle (30); a liquid supply path (10) for a coating liquid; a pneumatic transportation device (20) for transporting the coating liquid pneumatically; a liquid supply valve (50) for opening/shutting the liquid supply path (10); a pump (40) configured so as to be capable of suctioning the coating liquid inside the slit nozzle (30); a residual-pressure removal means (80) for removing the residual pressure inside the slit nozzle (30); and a control section (70) for controlling the operation of the liquid supply valve (50), the pump (40), and the residual-pressure removal means (80); wherein the coating liquid remaining inside the slit nozzle (30) is suctioned at the end of coating after pumping of the coating liquid is stopped and the residual pressure inside the slit nozzle (30) is removed. With this configuration the coating device improves responsive at the end of the coating without a complicated control procedure.

6 Claims, 11 Drawing Sheets

(51) Int. Cl.

| | |
|---|---|
| ***B05B 1/34*** | (2006.01) |
| *B05C 5/02* | (2006.01) |
| *B05D 1/26* | (2006.01) |

(52) U.S. Cl.
CPC ..... *B05C 11/1002* (2013.01); *B05C 5/0258* (2013.01); *B05D 1/26* (2013.01); *B05D 2252/02* (2013.01)

(56) References Cited

U.S. PATENT DOCUMENTS

2001/0012588 A1* 8/2001 Kaido ..... H01M 4/04
429/233
2012/0097096 A1* 4/2012 Yang ..... B05C 5/0258
118/300

FOREIGN PATENT DOCUMENTS

JP 2002-219400 A 8/2002
JP 2009-006225 A 1/2009
JP 4366757 B 9/2009

* cited by examiner

Low viscosity 20kPa 0.3mL/s

High viscosity 50kPa 0.8mL/s

Coating-start section
(Pneumatic transportation, Pump forward flow)

Coating-middle section
(Pneumatic transportation)

Low viscosity -0.3mL/s

High viscosity -0.8mL/s

100mm/s

Coating-end section
(Pump reverse flow)

Intermittent region

PRIOR ART

COATING APPARATUS AND COATING METHOD

TECHNICAL FIELD

The present invention relates to a coating apparatus and a coating method, and particularly, to a coating apparatus and a coating method suitable for performing an intermittent coating process onto a sheet-like work (web).

BACKGROUND ART

In Patent Literature 1, as shown in FIG. 8, proposed is a coating apparatus 101 that is provided with a pressurizing air line (constant pressure supply means) 120, a coating liquid tank 130, a supply pipe arrangement 140, a supply valve 150, a constant-volume pump (constant-volume supply means) 160, a discharging pipe arrangement 170, a discharging valve 180, a slit nozzle 190, a movable stage 200 and a control section. The pressurizing air line 120 is connected to the coating liquid tank 130, and supplies the air compressed with a compressor or the like to the interior of the coating liquid tank 130, thereby applying a constant pressure to a coating liquid in the coating liquid tank 130. The coating liquid tank 130 is connected to an inlet of the constant-volume pump 160 by the supply pipe arrangement 140. The supply valve 150 is disposed in the middle of the supply pipe arrangement 140, and a pneumatic transportation of the coating liquid is commenced following an opening action of the supply valve 150.

For the constant-volume pump 160, a piston pump in which a piston is disposed inside a cylinder in such a manner as to be capable of reciprocating motion or the like is employed, and displaces a constant volume of the coating liquid inside the cylinder as the piston is caused to perform a forward motion at a constant speed by an AC servo-motor or the like. An outlet of the constant-volume pump 160 is connected to the slit nozzle 190 by the discharging pipe arrangement 170. The discharging valve 180 is disposed in the middle of the discharging pipe arrangement 170, and following an opening action of the discharging valve 180, transportation of a constant volume of the coating liquid is commenced by the constant-volume pump 160.

Below the slit nozzle 190 is installed a movable stage 200 that moves at a constant speed. A leaflike work W such as glass substrate is sticked and held by suction on the movable stage 200. By discharging the coating liquid from the slit nozzle 190, the coating liquid is applied onto the work W that is moved together with the movable stage 200.

Operation of the coating apparatus 101 that is described in the Patent Literature 1 is explained. At a start of the coating, the control section 210, by causing the pressurizing air line 120 to be driven, the discharging valve 180 to shut and the supply valve 150 to open, raises the pressure inside the coating liquid tank 130. Then, the control section 210, by causing the discharging valve 180 to open and the supply valve 150 to shut, starts discharging the coating liquid from a front edge of the slit nozzle 190. At the same time, the control section 210, controlling the movable stage 200, causes either of the work W and the slit nozzle 190 to move relative to the other.

After that, the control section 210 causes the pressurizing air line 120 to stop, and sets the pressure inside the coating liquid tank 130 to return to the atmospheric pressure. Thereafter, transportation of the coating liquid is achieved by the constant-volume pump 160 alone with a flow rate maintained at a constant value, and thereby a coating process is performed with a uniform film thickness. At an end of the coating, the control section 210, by causing the discharging valve 180 to shut and the supply valve 150 to open, forcibly halts the supply of the coating liquid to the slit nozzle 190.

CITATION LIST

Patent Literature

[Patent Literature 1]
Japanese Patent No. 4,366,757 bulletin

SUMMARY OF INVENTION

Technical Problem

Usually, as a principal means for transporting the coating liquid, a constant-volume pump is employed with which it is easy to control a flow rate at a constant value. However, because transporting the coating liquid by the constant-volume pump causes a delay in response at an initial stage of an operation of the pump, a discharge pressure cannot be raised sufficiently high. Then, according to the Patent Literature 1, by utilizing the pneumatic transportation by means of the pressurizing air line 120 supplementally at a start of the coating as described above, it has been made possible to compensate the deficiency in the discharge pressure, and thereby to suppress the delay in response at the initial stage of the operation of the constant-volume pump 160.

However, at the end of the coating, because the only thing done is that supply of the coating liquid to the nozzle 190 is halted basically by shutting the discharging valve 180, responsiveness worsens. In other words, it occasionally happens that uncontrollable coating liquid that remains at the front edge of the slit nozzle flows out due to self-weight and/or inertia, and thereby that a coated film is spread at a coating-end section. Additionally, in a case where the coating liquid is a low-viscosity coating liquid, there is a problem that the coating-end section becomes not aligned linearly.

In particular, in a case where what is called an intermittent coating process in which forming a coated film of a predetermined coating length is repeated continually with a gap in between onto a long-shaped work is carried out, because the movable stage 200 continues being moved until an entire coating process onto one work is completed, an yield is reduced considerably and therefore loss of material costs amounts to a great extent if a coating failure as described above occurs.

Besides, in the coating apparatus 101 of the Patent Literature 1, operations of not only the constant-volume pump 160 but also the pressurizing air line 120 as well as the two dispensing and discharging valves 150, 180 have to be controlled for each single coating operation, which requires a complicated control system. As a result, a tact time increases so as to obtain a coated film of good quality, so that productivity decreases. Indeed, in the Patent Literature 1, it is assumed that the coating process is performed once onto one piece of the leaflike work.

The present invention was contrived to solve the above-mentioned technical problems, and is directed to forming a coated film of good quality by improving the responsiveness at an end of the coating without the need for a complicated control.

Solution to Problem

A coating apparatus forms a coated film of a predetermined length by supplying a coating liquid to a slit nozzle disposed facing a work, causing either one of the work and the slit nozzle to move relative to the other, and discharging the coating liquid onto a surface to be coated of the work from a front edge of the slit nozzle.

The coating apparatus of the present invention includes a slit nozzle, a liquid supply path, a pneumatic transportation device, a liquid supply valve, a motion device, a liquid suction means and a control section. The slit nozzle discharges the coating liquid from a front edge onto a surface to be coated of the work. The liquid supply path is connected to the slit nozzle. Flowing through the liquid supply path, the coating liquid is supplied to the slit nozzle. The pneumatic transportation device transports the coating liquid by always applying a constant pressure in a certain direction to the coating liquid in the liquid supply path. The liquid supply valve opens and shuts the liquid supply path. The motion device causes either one of the work and the slit nozzle to move relative to the other. The liquid suction means is configured in such a manner as to be capable of sucking the coating liquid in the slit nozzle. The control section controls operations of the liquid supply valve and the liquid suction means.

With this configuration, at an end of a coating, the control section causes the liquid supply valve to shut and the liquid suction means to operate, and thereby remnant of the coating liquid remaining at the front edge of the slit nozzle is sucked. In other words, responsiveness at the end of the coating is improved, so that a coated film is prevented from being spread or becoming uneven at a coating-end section.

For the liquid suction means, a pump can be given as an example. The pump is disposed downstream from the liquid supply valve in the direction of the flow of the coating liquid in the liquid supply path, and is configured in such a manner as to be capable of applying a negative pressure to the coating liquid in the liquid supply path.

With this configuration, at the end of the coating, when the pneumatic transportation of the coating liquid by means of the pneumatic transportation device is stopped by shutting the liquid supply valve and the negative pressure is applied to the coating liquid in the liquid supply path by driving the pump, the coating liquid in the liquid supply path flows in the opposite direction. This causes the remnant of the coating liquid remaining at the front edge of the slit nozzle to be sucked. Further, because the pump is used supplementally while the pneumatic transportation device is used as a principal liquid transportation means, necessary performance can be achieved with a small-volume pump. Therefore, the configuration also contributes to the reduction of an equipment cost.

In order to further improve the responsiveness at the end of the coating, the coating apparatus of the present invention may further include a residual pressure removal means that is controlled by the control section and configured in such a manner as to be capable of removing a residual pressure inside the slit nozzle.

With this configuration, at the end of the coating, as a first stage, the control section, by causing the liquid supply valve to shut and the discharge pressure removal means to operate, removes the residual pressure of the slit nozzle. Subsequently, as a second stage, the control section, by causing the liquid suction means to operate, sucks the coating liquid in the slit nozzle. That is to say, because the residual pressure has been removed beforehand by the residual pressure removal means, the coating liquid that is to be sucked by the liquid suction means acquires further improvement in the responsiveness at the end of the coating as compared with a case where it is sucked by the liquid suction means alone.

One example of such a residual pressure removal means includes a pipe arrangement which is connected to the slit nozzle and of which distal end is open to the atmosphere, and a residual pressure removal valve that opens and shuts the pipe arrangement being controlled by the control section. With this configuration, because the pipe arrangement is opened to the atmosphere when the control section causes the residual pressure removal valve to open, the residual pressure inside the slit nozzle is removed.

For the pump, a constant-volume pump that is switchable between forward and reverse flow drives can be suitably used. This configuration enables a positive pressure to be applied to the coating liquid in the liquid supply path by driving the constant-volume pump for a forward flow, and a negative pressure to be applied to the coating liquid in the liquid supply path by driving the constant-volume pump for a reverse flow.

At the start of the coating, the liquid supply valve is caused to open, and the constant-volume pump is caused to be driven for the forward flow in order to apply a positive pressure to the coating liquid in the liquid supply path. With this configuration, at the start of the coating, when the pneumatic transportation of the coating liquid by means of the pneumatic transportation device is started by an opening action of the liquid supply valve and the positive pressure is applied to the coating liquid in the liquid supply path by driving the constant-volume pump for the forward flow, the coating liquid is supplied to the slit nozzle quickly. In other words, responsiveness at the start of the coating is improved. Moreover, compensating a deficiency in discharge pressure at the start of the coating by driving the constant-volume pump for the forward flow makes it possible to decrease a coating-start section of a coated film having nonuniform film thickness. In particular, in a case where an intermittent coating process is carried out onto a long-shaped work, a high yield can be attained, which contributes to the reduction of materials cost.

Especially, when the viscosity of the coating liquid used becomes large, it becomes hard for the pressure applied to the coating liquid to follow the operation of the pump; so that it becomes necessary to start driving the pump earlier accordingly. Even in such a case, the constant-volume pump can manage the pressure applied to the coating liquid relatively easily by controlling a flow rate of the pump. Therefore, it is easy to respond to a change of the coating liquid.

After the discharge pressure is raised sufficiently high by compensating the deficiency in discharge pressure with the constant-volume pump being driven for the forward flow at the start of the coating, the pneumatic transportation of the coating liquid by means of the pneumatic transportation device alone is realized with the operation of the constant-volume pump being stopped. Because the pneumatic transportation during this period is carried out under a constant pressure, the discharge pressure also becomes virtually constant; so that the coating liquid is discharged with a virtually constant flow rate from the front edge of the slit nozzle, and thereby a coated film with a uniform film thickness can be formed on the surface to be coated of the work.

Further, in a case where the motion device is configured in such a manner as to continuously convey a sheet-like work (web) at a constant speed, it is possible to carry out a roll-to-roll intermittent coating process while the sheet-like work is moved continuously. This makes it possible to shorten the tact time, and therefore productivity is increased.

Advantageous Effects of Invention

According to the present invention, when transportation of a coating liquid by means of a pneumatic transportation device is forcibly stopped by a shutting action of a liquid supply valve, remnant of the coating liquid remaining at a front edge of a slit nozzle is sucked by operating a liquid suction means. Therefore, responsiveness at the end of a coating is improved without the need for a complicated control. This makes sure that a coated film is prevented from being spread or becoming uneven at a coating-end section, thereby reducing the occurrence of coating failures.

Additionally, in a case where a reversible pump which is the pump switchable between forward and reverse flow drives is used as the liquid suction means, when the transportation of the coating liquid by means of the pneumatic transportation device is resumed through an opening action of the liquid supply valve, deficiency in discharge pressure at the slit nozzle is compensated by driving the reversible pump for a forward flow. Therefore, responsiveness at the start of the coating can also be improved.

DESCRIPTION OF EMBODIMENTS

Figure 1:
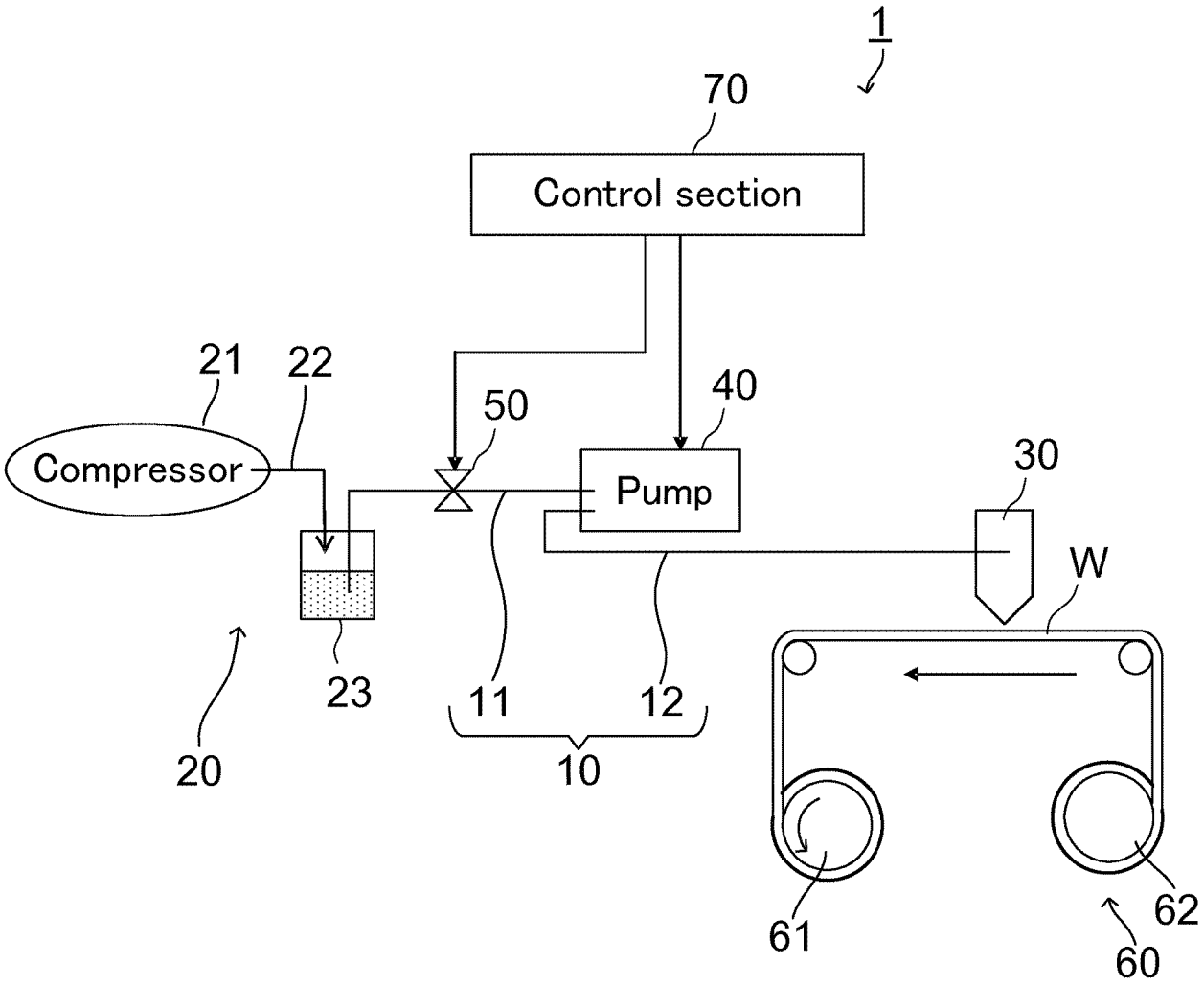
FIG. 1 is a diagram showing a general configuration of a coating apparatus according to a first embodiment of the present invention.

A coating apparatus of the present invention is configured in such a manner as to form a coated film of a predetermined length by supplying a coating liquid to a slit nozzle disposed facing a work, causing either one of the work and the slit nozzle to move relative to the other, and discharging the coating liquid onto a surface to be coated of the work from a front edge of the slit nozzle. Hereinafter, embodiments of the present invention are explained, referring to the drawings.

FIG. 1 is a diagram showing a general configuration of a coating apparatus according to a first embodiment of the present invention. As shown in FIG. 1, the coating apparatus 1 includes a liquid supply path 10, a pneumatic transportation device 20, a slit nozzle 30, a pump 40, a liquid supply valve 50, a motion device 60 and a control section 70.

The liquid supply path 10 is a pipe arrangement through which a coating liquid flows, and consists of two pipe arrangements of a first pipe arrangement 11 and a second pipe arrangement 12. In the embodiment, because a pneumatic transportation device is used as a principal liquid transporting means, the pipe arrangements 11, 12 constituting the liquid supply path 10 are preferably made of material(s) capable of withstanding a high pressure (several 10 kPa), so that Teflon (registered trademark) tubes are used, for example. In a case where the pressure increases (not smaller than 0.3 MPa), a steel pipe is preferably used. The first pipe arrangement 11 connects the coating liquid tank 23 to an inlet of the pump 40, and the second pipe arrangement 12 connects an outlet of the pump 40 to the slit nozzle 30.

The pneumatic transportation device 20 consists of, as an example, a compressor 21 that compresses the air, a pressure-proof pipe arrangement 22 through which a compressed air flows, and the coating liquid tank 23. The coating liquid tank 23 is an airtight container that receives the coating liquid. A downstream end of the pressure-proof pipe arrangement 22 is connected to the coating liquid tank 23 at a portion thereof above a surface of the coating liquid contained therein. An upstream end of the above-mentioned first pipe arrangement 11 is inserted into the coating liquid in the coating liquid tank 23.

The pressure-proof pipe arrangement 22 supplies the air compressed by the compressor 21 to the interior of the coating liquid tank 23, and applies a constant pressure to the coating liquid in the coating liquid tank 23. The coating liquid pressurized in the coating liquid tank 23 is pushed into the liquid supply path 10. With a constant pressure being steadily applied to the coating liquid in the liquid supply path 10 in a certain direction, the coating liquid is caused to be pneumatically transported through the liquid supply path 10 and to start being supplied to the slit nozzle 30. Here, by providing a pressure regulating valve (regulator) or the like on the outlet's side of the coating liquid tank 23, the pressure applied to the coating liquid may be adjusted to be precisely constant. In the present invention, the pneumatic transportation device 20 of this sort is used as the principal liquid transportation means.

The slit nozzle 30 is disposed most downstream in the direction of the flow of the coating liquid through the liquid supply path 10. The slit nozzle 30 virtually has a rectangular parallelepiped shape, and is disposed above the work W in such a manner that its lengthwise direction agrees with a direction perpendicular to a conveyance direction of the work W. A front edge portion (lower edge portion) of the slit nozzle 30 is formed into a tapering off shape, having a slit-like discharge opening at its front edge. The slit nozzle 30 is disposed facing the work W with a predetermined gap between its discharge opening at the front edge and the work W; and with the coating liquid discharged from the discharge opening, the coated film is formed onto the work W.

The pump 40 is one example of the liquid suction means of the present invention. It is configured in such a manner as to be capable of applying a positive pressure and a negative pressure to the coating liquid in the liquid supply path 10. For the pump 40, a constant-volume pump that is switchable between forward and reverse flow drives such as piston pump or diaphragm pump is used, as an example. That is to say, a positive pressure is applied to the coating liquid in the liquid supply path 10 when the volume pump is driven for a forward flow, and a negative pressure is applied to the coating liquid in the liquid supply path 10 when the constant-volume pump is driven for a reverse flow. Directions of the pressure applied and a flow rate of the pump 40 are controlled by the control section 70.

The liquid supply valve 50 is disposed upstream from the pump 40 in the direction of flow of the coating liquid through the liquid supply path 10. In other words, the pump 40 is disposed downstream from the liquid supply valve 50 in the direction of flow of the coating liquid through the liquid supply path 10. In the embodiment, the liquid supply valve 50 is disposed in the first pipe arrangement 11. The pneumatic transportation of the coating liquid by means of the pneumatic transportation device 20 is stopped by a shutting action of the liquid supply valve 50. Opening and shutting of the liquid supply valve 50 is controlled by the control section 70.

The motion device 60 is configured in such a manner as to cause either one of the work W and the slit nozzle 30 to move relative to the other. In the embodiment, the motion device 60 is a device that moves the work W in relation to the slit nozzle 30 that is fixed. The motion device 60 is configured, for example, as a device that is provided with a rotationally driven winding roller 61 and a compliantly turned send-out roller 62 and that carries out continuously what is called a roll-to-roll conveyance of the work W at a constant speed by winding a sheet-like work (web) W that is wound and held around the winding roller 61 and the send-out roller 62 onto the winding roller 61.

The control section 70 is configured in such a manner as to control operations of the pump 40 and the liquid supply valve 50. The control section 70 consists of, as an example, a computer. In the present invention, it is the pump 40 and the liquid supply valve 50 that undergo changes in their operational states during an operation of the coating apparatus 1. Although the pneumatic transportation device 20 and the motion device 60 are also operated during the operation of the coating apparatus 1, these are not objects of control by the control section 70. The reason is that these maintain their steady states once their operations are started and their operational states are not changed.

Also, in the present invention, because the pump 40 is used supplementally while the pneumatic transportation device 20 is used as the principal liquid transportation means, necessary performance can be achieved with a small-volume pump. Because conditions to control in one coating operation are also few, a control mechanism can also be configured in a simple manner.

Figure 2:
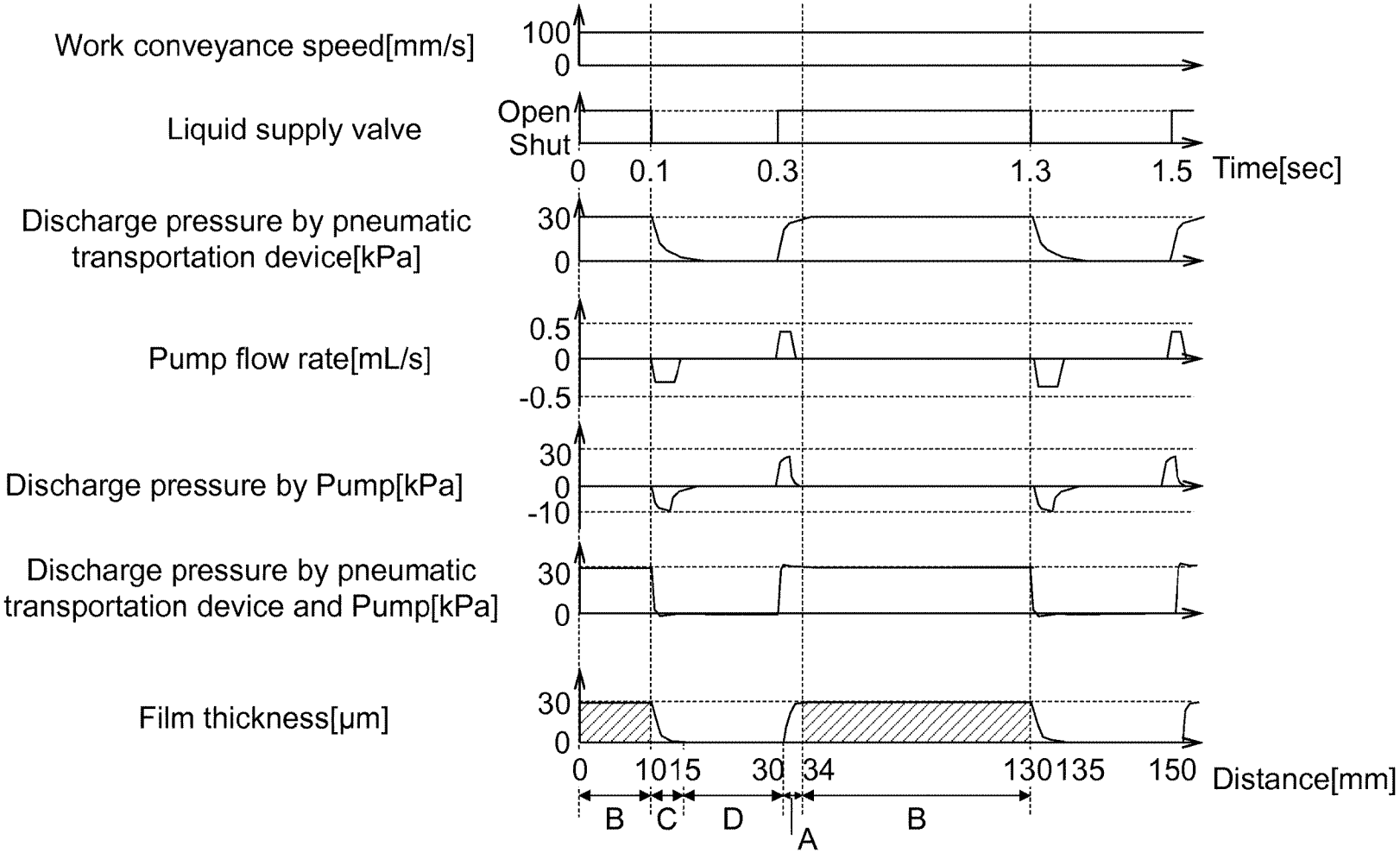
FIG. 2 is a time chart showing an example of control timings on respective sections and thereby caused variations of discharge pressures and film thickness in time in a case where an intermittent coating process onto a sheet-like work is performed by the above-mentioned coating apparatus using a coating liquid of low viscosity (1 to 10 cP).
Figure 3:
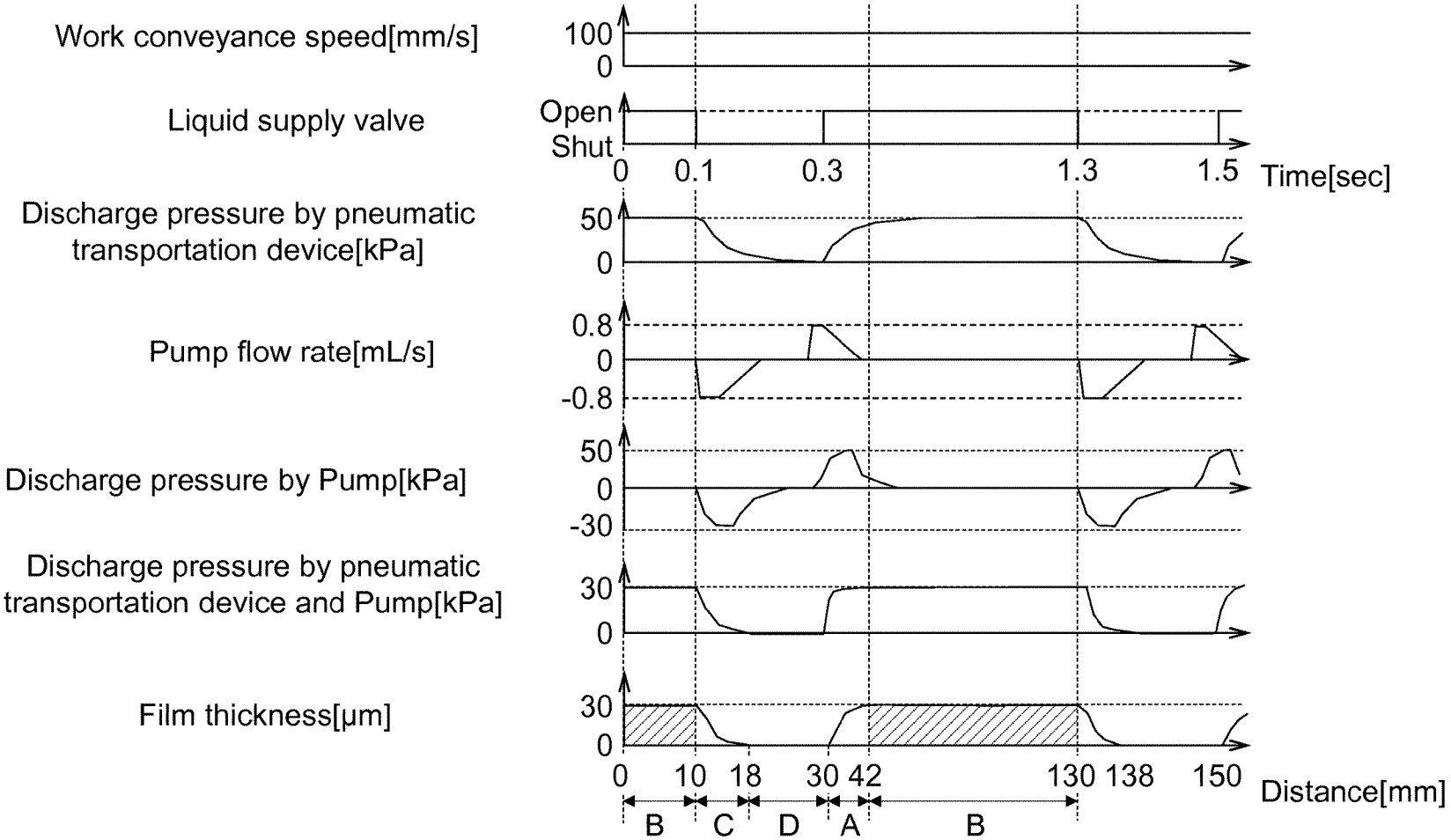
FIG. 3 is a time chart showing an example of control timings on respective sections and thereby caused variations of discharge pressures and film thickness in time in a case where an intermittent coating process onto a sheet-like work is performed by the coating apparatus using a coating liquid of high viscosity (not less than 100 cP).
Figure 4A:
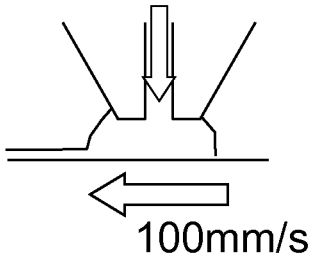
FIG. 4A through FIG. 4D are schematic block diagrams showing states of the coating liquid at a front edge of a slit nozzle respectively corresponding to the respective time periods A through D indicated in FIG. 2, FIG. 3.
Figure 4B:
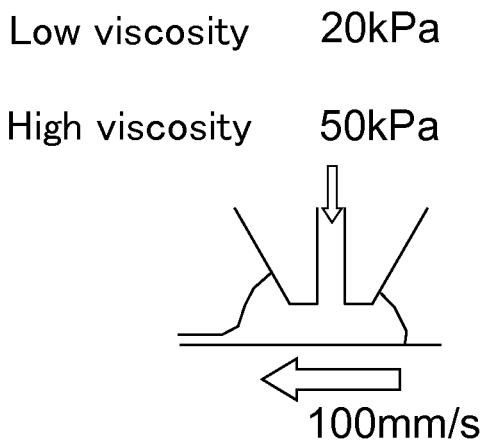
Figure 4C:
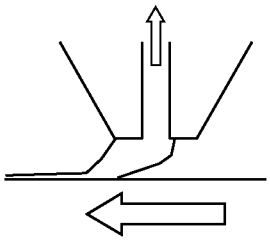
Figure 4D:
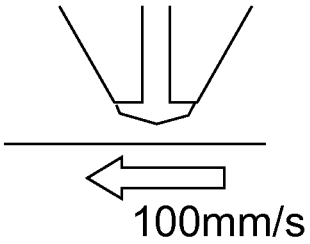

Subsequently, an operation of the coating apparatus 1 configured as above is explained, using FIG. 2 through FIG. 5. FIG. 2 is a time chart showing an example of control timings on respective sections and thereby caused variations of discharge pressures and film thickness in time in a case where an intermittent coating process onto a sheet-like work is performed by the above-mentioned coating apparatus 1 using a coating liquid of low viscosity (1 to 10 cP). FIG. 3 is a time chart showing an example of control timings on respective sections and thereby caused variations of discharge pressures and film thickness in time in a case where an intermittent coating process onto a sheet-like work is performed by the coating apparatus 1 using a coating liquid of high viscosity (not less than 100 cP). FIG. 4A through FIG. 4D are schematic block diagrams showing states of the coating liquid at the front edge of the slit nozzle respectively corresponding to the respective time periods A through D indicated in FIG. 2, FIG. 3.

Figure 5:
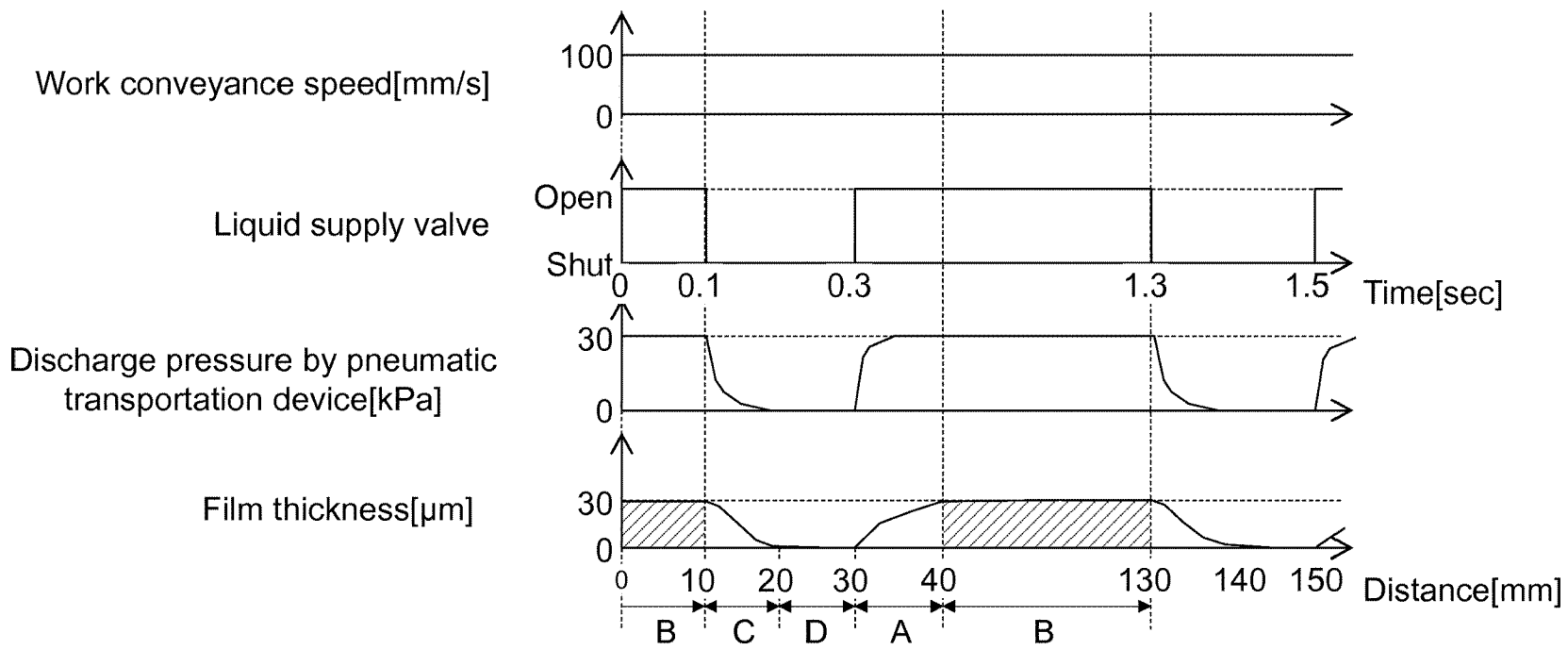
FIG. 5 is a time chart showing an example of control timings on respective sections and thereby caused variations of discharge pressures and film thickness in time in a case where an intermittent coating process onto a sheet-like work is performed using a coating liquid of low viscosity (1 to 10 cP) that is transported by means of a pneumatic transportation alone.

Because control details of a pressure supplied by the pneumatic transportation device, a timing for a start of driving and a flow rate of the pump change depending on the viscosity of the coating liquid used even when a coated film of the same length is formed, explanation will be made separately on the case of a coating liquid of low viscosity (1 to 10 cP) (FIG. 3), and on the case of a coating liquid of high viscosity (100 cP) (FIG. 2, FIG. 5).

Firstly, explanation is made on the case where a coating liquid used is of low viscosity, using FIG. 2, FIG. 4A through FIG. 4D. Here, it is assumed that while the coating apparatus 1 is operated the pneumatic transportation device 20 always supplies to the coating liquid tank a constant pressure by which the discharge pressure becomes 20 kPa, and that the motion device 60 continuously conveys a sheet-like work W at a constant rate of 100 mm/sec.

<Coating-Start Section (Refer to Section A of FIG. 2, FIG. 4A)>

Pressure supply to the coating liquid in the liquid supply path 10 by means of the pneumatic transportation device 20 is started by an opening action (0.3 sec. in time axis in FIG. 2) of the liquid supply valve 50. In reality, even when the liquid supply valve 50 is opened, the discharge pressure does not immediately rise to the predetermined 20 kPa due to the existence of a delay in response. Because a region having nonuniform film thickness is formed during that time, the time should be shortened as much as possible. Then, in order to compensate the deficiency in the discharge pressure, a positive pressure is applied to the coating liquid by driving the pump 40 for the forward flow at a predetermined flow rate (for example, 0.3 mL/sec.) synchronously with the opening action of the liquid supply valve 50. This makes it possible for the discharge pressure to come to reach a specified value in 0.04 sec. after the opening action of the liquid supply valve 50, so that a length of the coating-start section of a coated film having nonuniform film thickness remains within 4 mm.

For comparison, shown in FIG. 5 is a time chart of a case where a similar coated film is formed using the same coating liquid of low viscosity with the coating liquid being discharged through the pneumatic transportation alone by means of the pneumatic transportation device 20 without using the pump 40 (with the same timings of opening-shutting actions of the liquid supply valve 50). In this case, it takes 0.1 sec. for the discharge pressure to reach the specified value, so that the length of the region of the coated film having nonuniform film thickness reaches as much as 10 mm. From this comparison, it is recognizable that utilizing the pump supplementally at a start of the coating increases the responsiveness and thereby has an effect of shortening the length of the coating-start section of the coated film having nonuniform film thickness.

<Coating-Middle Section (Refer to Section B of FIG. 2, FIG. 4B)>

After the driving of the pump 40 for the forward flow is stopped, discharge of the coating liquid is performed through the pneumatic transportation alone by means of the pneumatic transportation device 20. Because the discharge pressure becomes stable after reaching the specified value, a discharge flow rate also becomes stable; and thus a coated film of a uniform film thickness is obtained. The coating-middle section (refer to a hatched region in FIG. 2) is a region having a uniform film thickness, and is a usable region of the coated film in which processing such as etching and/or the like can be carried out. That is to say, the longer the length of the coating-middle section is, the better the quality of the coated film becomes. In FIG. 2, it is 96 mm that corresponds to the length of the coating-middle section.

<Coating-End Section (Refer to Section C of FIG. 2, FIG. 4C)>

The pressure supply to the coating liquid in the liquid supply path 10 by means of the pneumatic transportation device 20 is halted by a shutting action (1.3 sec. in time axis in FIG. 2) of the liquid supply valve 50. In reality, even when the liquid supply valve 50 is shut, the discharge pressure does not immediately become zero due to the existence of a delay in response. During that time, because the coating liquid in the downstream side of the liquid supply valve 50 is not controlled, there is a risk that remnant of the coating liquid remaining at the front edge of the slit nozzle 30 flows out due to self-weight, and/or inertia, and thereby that a coated film is spread and/or becomes uneven at the coating-end section. Then, in order to decrease an excess of the discharge pressure, a negative pressure is applied to the coating liquid by driving the pump 40 for the reverse flow at a predetermined flow rate (for example, −0.3mL/sec.). This enables the discharge pressure to become zero in 0.05 sec. after the shutting action of the liquid supply valve 50. This also enables the length of the coating-end section of the coated film having nonuniform film thickness to remain within 5 mm.

On the other hand, as shown in FIG. 5, in the case where using the same coating liquid of low viscosity the coating liquid is discharged through the pneumatic transportation alone by means of the pneumatic transportation device 20 without using the pump 40, it takes 0.1 sec. for the discharge pressure to reach the specified value, so that the length of the region of the coated film having nonuniform film thickness reaches as much as 10 mm. From this comparison, by driving the pump 40 supplementally at an end of the coating, it is expected that the remnant of the coating liquid remaining at the front edge of the slit nozzle 30 is sucked, and that thereby an effect of improving the cutting off of the coating liquid is produced. In other words, responsiveness at the end of the coating is improved; so that the coated film is prevented from being spread or becoming uneven at the coating-end section.

<Intermittent Region (Refer to Section D of FIG. 2, FIG. 4D)>

When the discharge pressure becomes zero (1.35 sec. in the time axis in FIG. 2), the coating liquid becomes not discharged, and thereby formation of the coated film is stopped. Then, the liquid supply valve 50 is opened again (1.5 sec. in the time axis in FIG. 2), and thereby discharge of the coating liquid is resumed from the front edge of the slit nozzle 30.

In this manner, coated films each consisting of one coating-start section, one coating-middle section and one coating-end section are repeatedly formed onto a continuously conveyed work sandwiching each intermittent region in between.

Subsequently, using FIG. 3, FIG. 4A through FIG. 4D, explanation is made on a case where a coating liquid of high viscosity (not less than 100 cP) is used. Here, it is assumed that while the coating apparatus 1 is operated the pneumatic transportation device 20 always supplies to the coating liquid tank a constant pressure by which the discharge pressure becomes 50 kPa that is higher as compared with the case of the coating liquid of low viscosity. The moving rate of the motion device 60 and the timings of the opening-shutting actions of the liquid supply valve 50 are the same as in the case of the coating liquid of low viscosity.

As the viscosity of the coating liquid rises, response of the discharge pressure to the opening-shutting actions of the liquid supply valve 50 reduces. Then, in the coating-start section (section A), the pump 40 is caused to be driven for the forward flow at a predetermined flow velocity (0.8 mL/sec. in FIG. 3) slightly earlier than the opening action of the liquid supply valve 50. On the other hand, in the coating-end section (section C), the pump 40 is driven for the reverse flow synchronously with the shutting action of the liquid supply valve 50; however, starting up of the pump 40 is carried out quickly and shutting down thereof is carried out taking time in order that the pump 40 is driven somewhat longer.

This makes it possible to compensate the lowering of the response due to a high viscosity of the coating liquid by carrying out adjustments on a driving start timing and/or a flow rate of the pump 40 that is supplementally utilized at the coating-start section and the coating-end section without changing the moving rate of the motion device 60 or the timings of the opening-shutting actions of the liquid supply valve 50. Therefore, even when the viscosity of the coating liquid changes, it is made possible to form coated films of a constant quality continually without impairing productivity by means of the intermittent coating process.

Additionally, although, in the above-mentioned embodiment, the motion device 60 is configured in such a manner as to move the work W in relation to the slit nozzle 30, the slit nozzle 30 may be configured in such a manner as to move in relation to the work W with the slit nozzle 30 being supported by a flexible support member. However, when the slit nozzle 30 is moved, it is necessary at least to employ a flexible tube as the second pipe arrangement 12.

Figure 6:
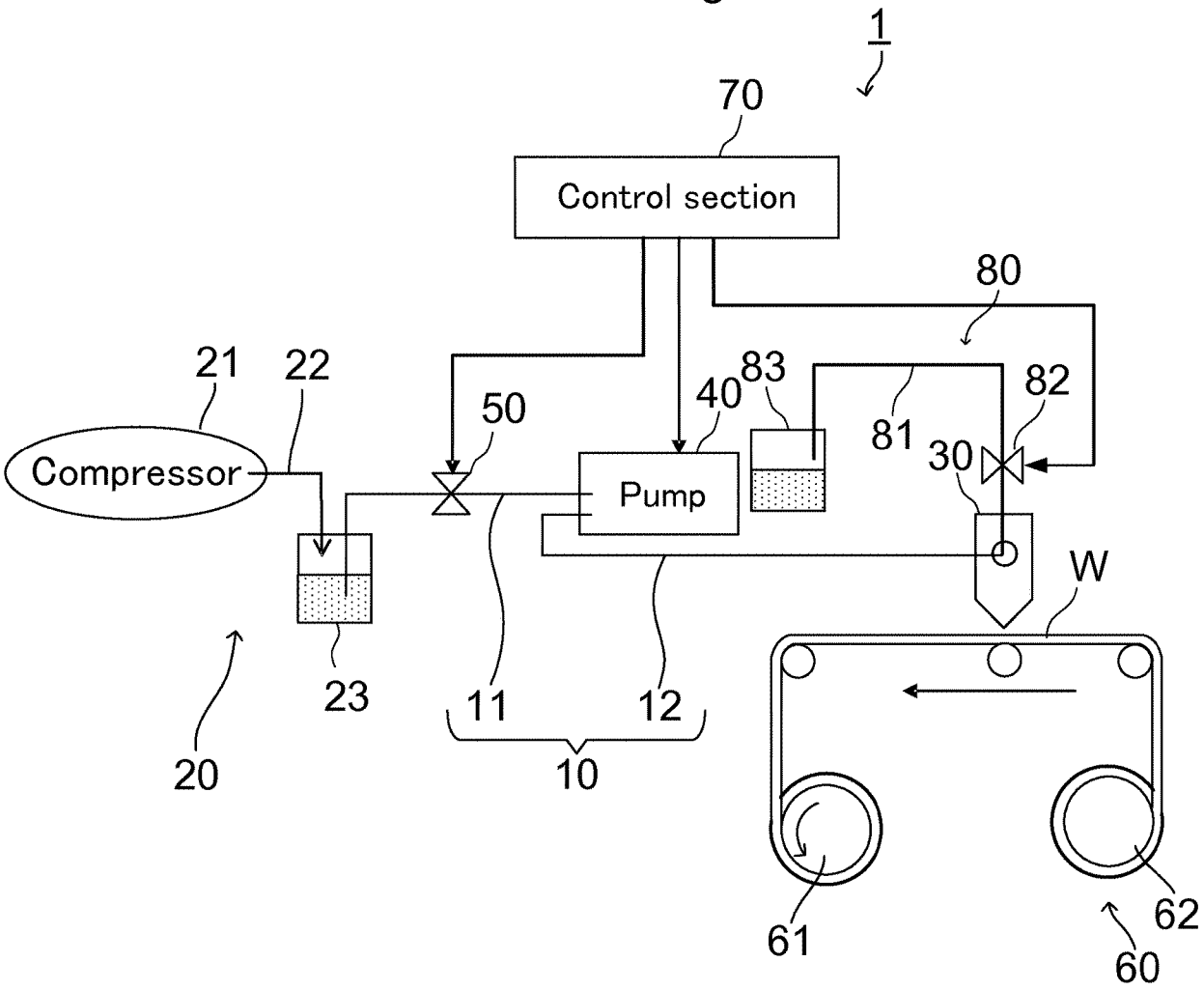
FIG. 6 is a diagram showing a general configuration of a coating apparatus according to a second embodiment of the present invention.

FIG. 6 is a diagram showing a general configuration of a coating apparatus according to a second embodiment of the present invention. In cases where a high viscous coating liquid is treated, where the amount of coating is large even in low viscosity, or where the slit discharging the coating liquid is narrow and so forth, as a behavior of the coating apparatus at the end of the coating, a residual pressure occurs by a resistance force such as viscous resistance when the liquid supply valve 50 is brought to the state of being shut. In such cases, sucking of the coating liquid by driving the pump 40 for the reverse flow starts from the removal of the residual pressure. That is to say, one beat of delay in response occurs before the sucking of the coating liquid is actually started as compared with cases except the cases in such conditions as above-mentioned. This causes the coated film to spread at the coating-end section.

Then, the coating apparatus 1 according to this embodiment further includes a residual pressure removal means 80, as shown in FIG. 6. The residual pressure removal means 80 is configured in such a manner as to remove the above-mentioned residual pressure acting onto the coating liquid in the slit nozzle 30. The residual pressure removal means 80 includes, as an example, a pipe arrangement 81 and a residual pressure removal valve 82. One end of the pipe arrangement 81 is connected to the slit nozzle 30, and the other end is open to the atmosphere. The residual pressure removal valve 82 performs opening-shutting actions being controlled by the control section 70.

By providing the residual pressure removal valve 82 in the neighborhood of the slit nozzle 30, the removal of the residual pressure is performed more effectively. Also, by having the pipe arrangement 81 with a relatively large diameter (for example, a diameter of φ10 mm when the diameters of the pipe arrangements 11, 12 constituting the liquid supply path 10 are φ4-6 mm), effective removal of the residual pressure is enabled even in the case of the coating liquid of high viscosity. Moreover, by extending the pipe arrangement 81 vertically upward from the slit nozzle 30 and disposing the residual pressure removal valve right above the slit nozzle 30, it is also made possible to discharge the air accumulated in the slit nozzle 30 simultaneously with the removal of the residual pressure. The coating liquid produced by the removal of the residual pressure is collected into a drain bottle or the like. Because it is the coating liquid that has not been used yet, a saving of the coating liquid can be attempted if it is returned to the coating liquid tank 23 and recycled.

Figure 7:
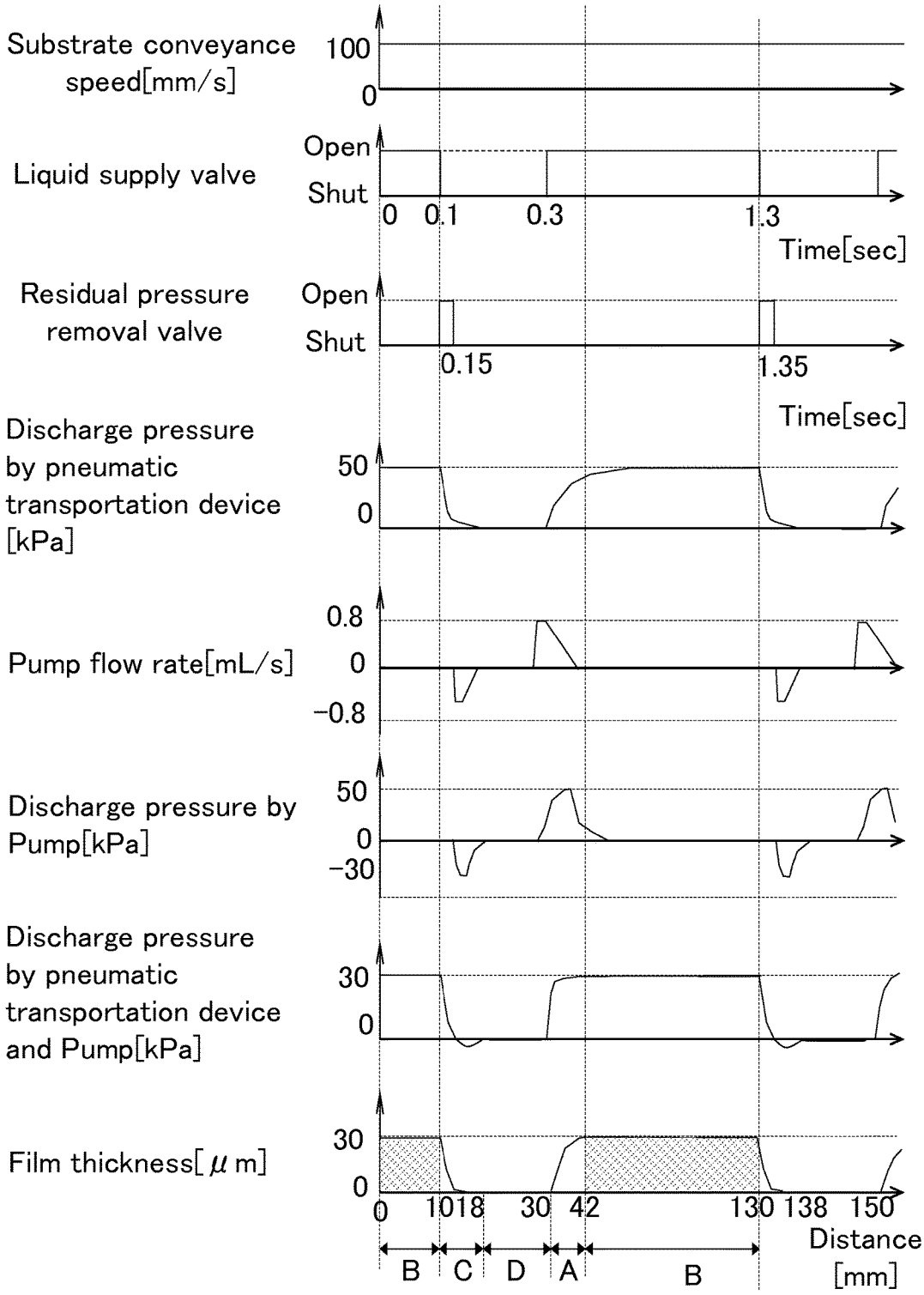
FIG. 7 is a time chart showing an example of control timings on respective sections and thereby caused variations of discharge pressures and film thickness in time in a case where an intermittent coating process onto a sheet-like work is performed by the above-mentioned coating apparatus using a coating liquid of high viscosity (not less than 100 cP).
Figure 8:
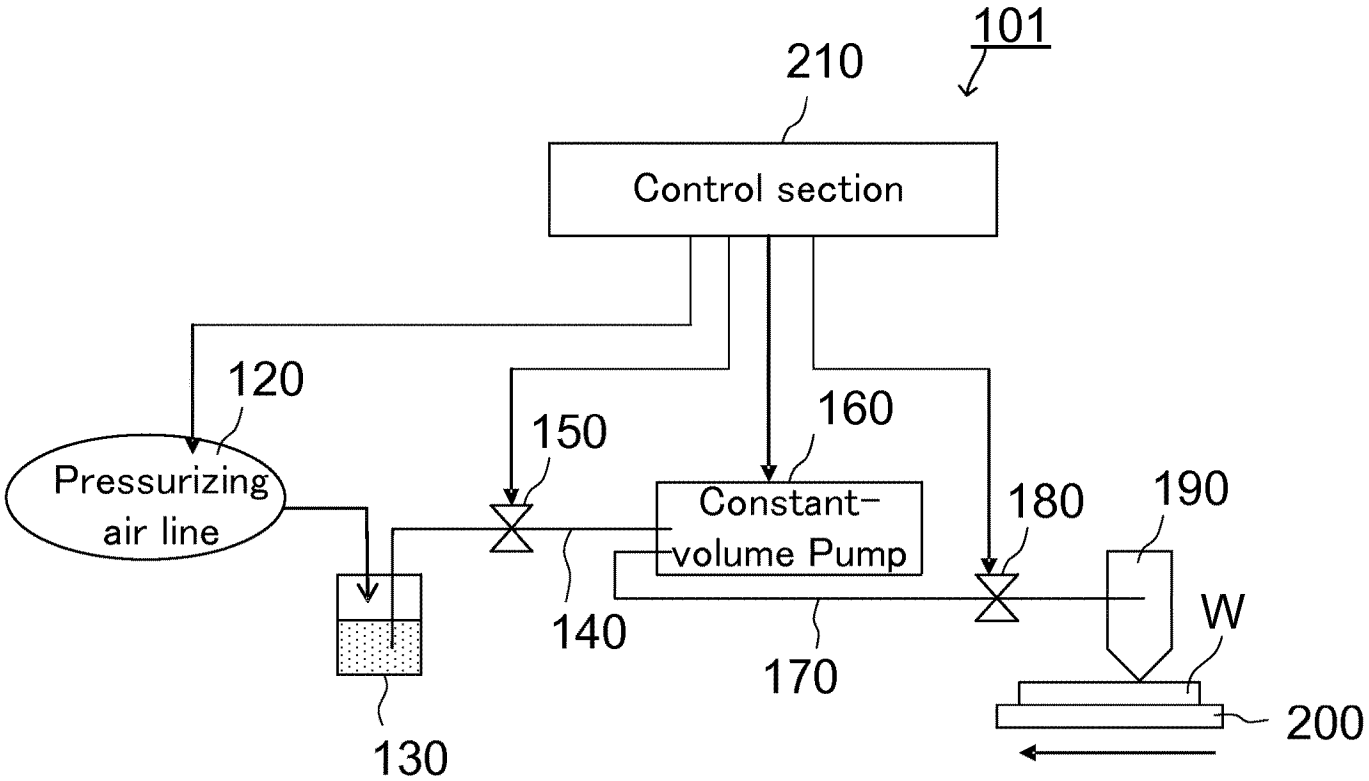
FIG. 8 is a diagram showing a general configuration of an example of a coating apparatus according to the prior-art.

As to timings of operations of the liquid supply valve 50, the pump 40 and the residual pressure removal valve 82, as shown in FIG. 7, at the end of the coating, the residual pressure removal valve 82 is controlled to open synchronously with the liquid supply valve 50 being controlled to shut; then the removal of the residual pressure starts. A time during which the residual pressure removal valve 82 is maintained in an open state is set to, as an example, 0.05 sec. to 0.5 sec. (0.15 sec. in an example of FIG. 7). When the removal of the residual pressure is completed, the residual pressure removal valve 82 is controlled to shut and the pump 40 is driven for the reverse flow, and thereby the remnant of the coating liquid at the front edge of the slit nozzle 30 is sucked.

The above explanations of the embodiments are nothing more than illustrative in any respect, nor should be thought of as restrictive. Scope of the present invention is indicated by claims rather than the above embodiments. Further, it is intended that all changes that are equivalent to a claim in the sense and realm of the doctrine of equivalence be included within the scope of the present invention.

INDUSTRIAL APPLICABILITY

The present invention is useful for an intermittent coating process in which coated films of a predetermined length are formed repeatedly onto a long-shaped work.

REFERENCE SIGNS LIST

W . . . work
1 . . . coating apparatus
10 . . . liquid supply path
  11 . . . first pipe arrangement
  12 . . . second pipe arrangement
20 . . . pneumatic transportation device
  21 . . . compressor
  22 . . . pressure-proof pipe arrangement
  23 . . . coating liquid tank
30 . . . slit nozzle
40 . . . pump
50 . . . liquid supply valve
60 . . . motion device
  61 . . . winding roller
  62 . . . send-out roller
70 . . . control section
80 . . . residual pressure removal means
81 . . . pipe arrangement
82 . . . residual pressure removal valve

The invention claimed is:

1. A coating apparatus for forming a coated film of a predetermined length by supplying a coating liquid to a slit nozzle disposed facing a work, causing either one of the work and the slit nozzle to move relative to the other by a motion device, and discharging the coating liquid onto a surface to be coated of the work from a front edge of the slit nozzle, the coating apparatus comprising:

a liquid supply path connected to the slit nozzle and configured to supply the coating liquid to the slit nozzle;

a pneumatic transportation device transporting the coating liquid by always applying a constant pressure in a certain direction to the coating liquid in the liquid supply path;

a liquid supply valve opening and shutting the liquid supply path;

a pump that is switchable between forward and reverse flow drives, the pump being disposed downstream from the liquid supply valve in a direction of a flow of the coating liquid in the liquid supply path and supplementing pneumatic transportation of the coating liquid by means of the pneumatic transportation device; and a control section configured to control operations of the liquid supply valve and the pump, wherein:

the control section is configured to supplement the pneumatic transportation of the coating liquid with the pump at a start of coating by opening the liquid supply valve and driving the pump for a forward flow while the pneumatic transportation device supplies constant pressure to the coating liquid;

the control section is configured to perform the pneumatic transportation of the coating liquid only with the pneumatic transportation device following the start of coating by stopping driving the pump while keeping the liquid supply valve open; and the control section is configured to shut the liquid supply valve and drive the pump for a reverse flow at the end of coating.

2. The coating apparatus as claimed in claim 1, further comprising a residual pressure removal means that is controlled by the control section and configured in such a manner as to be capable of removing a residual pressure inside the slit nozzle.

3. The coating apparatus as claimed in claim 2, wherein the residual pressure removal means includes a pipe arrangement which is connected to the slit nozzle and of which a distal end is open to the atmosphere, and a residual pressure removal valve that opens and shuts the pipe arrangement being controlled by the control section.

4. The coating apparatus as claimed in claim 1, wherein the motion device is configured in such a manner as to continuously convey the work in the form of a sheet at a constant speed.

5. A coating method using the apparatus of claim 1 for forming the coated film of the predetermined length on the surface to be coated of the work by discharging thereto the coating liquid from the front edge of the slit nozzle, the coating liquid being pneumatically transported by the constant pressure supplied to the coating liquid in the liquid supply path, the work being relatively moved in relation to the slit nozzle with a predetermined gap being maintained between the work and the front edge of the slit nozzle, the coating method comprising:

sucking the coating liquid remaining at the front edge of the slit nozzle with stopping pneumatic transportation of the coating liquid at the end of coating.

6. A coating method using the apparatus of claim 1 for forming the coated film of the predetermined length on the surface to be coated of the work by discharging thereto the coating liquid from the front edge of the slit nozzle, the coating liquid being pneumatically transported the constant pressure supplied to the coating liquid in the liquid supply path, the work being relatively moved in relation to the slit nozzle with a predetermined gap being maintained between the work and the front edge of the slit nozzle, the coating method comprising:

sucking the coating liquid remaining in the slit nozzle after stopping pneumatic transportation of the coating liquid with removing a residual pressure inside the slit nozzle at the end of coating.

* * * * *